United States Patent [19]

Stoody

[11] 3,941,181

[45] Mar. 2, 1976

[54] PROCESS FOR CASTING FACED OBJECTS USING CENTRIFUGAL TECHNIQUES

[75] Inventor: Charles A. Stoody, Fullerton, Calif.

[73] Assignee: Stoody Company, Santa Fe Springs, Calif.

[22] Filed: Aug. 5, 1974

[21] Appl. No.: 494,695

Related U.S. Application Data

[63] Continuation-in-part of Ser. No. 254,295, May 17, 1972, abandoned.

[52] U.S. Cl. ..... 164/59; 164/97; 164/114

[51] Int. Cl.[2] ..... B22D 19/06

[58] Field of Search ..... 164/33, 97, 58, 59, 114, 164/115, 116, 117, 118, 112; 51/206 R

[56] References Cited

UNITED STATES PATENTS

| | | | |
|---|---|---|---|
| 1,699,612 | 1/1929 | Doat | 164/33 X |
| 2,260,593 | 10/1941 | Wittlinger et al. | 164/97 |
| 2,645,558 | 7/1953 | Burchartz | 164/33 X |
| 3,028,644 | 4/1962 | Waldrop | 164/97 |
| 3,553,905 | 1/1971 | Lemelson | 51/206 R |
| 3,836,341 | 9/1974 | Saltzman et al. | 164/114 X |

*Primary Examiner*—Francis S. Husar
*Assistant Examiner*—John E. Roethel
*Attorney, Agent, or Firm*—Nilsson, Robbins, Bissell, Dalgarn & Berliner

[57] ABSTRACT

A system is disclosed for casting rollers having an external cylindrical surface defined by firmly-held carbide particles. As disclosed, a cylindrical mold is revolved about a central horizontal axis and heavy, tungsten-carbide particles are released within the mold to accumulate as a layer on the internal cylindrical surface of the mold. Molten metal of specific characteristics is injected into the mold; being lighter does not displace the particles at the mold surface yet forces and characteristics are such that the metal wets the particles and fills the interstices therebetween to provide an effective matrix upon solidification. Heat treatment overcomes the problem attendant the inherent rapid cooling, after which the metal may be machined. Requisite characteristics of the metal for the disclosed process include: dimensional stability, high compressive yield strength, high shock and impact resistance, and good casting characteristics as high fluidity and low surface tension to "wet" the tungsten-carbide particles.

11 Claims, 5 Drawing Figures

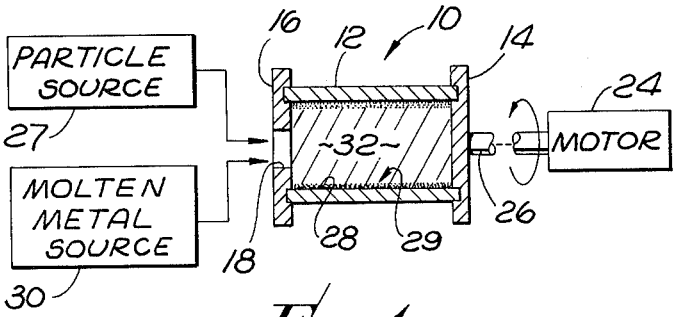
Fig. 1.
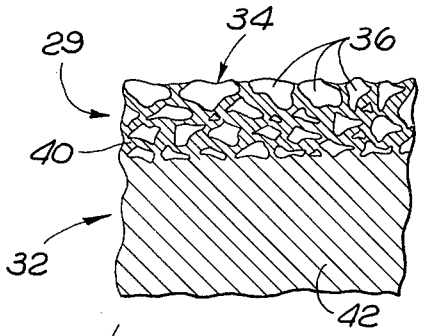
Fig. 2.
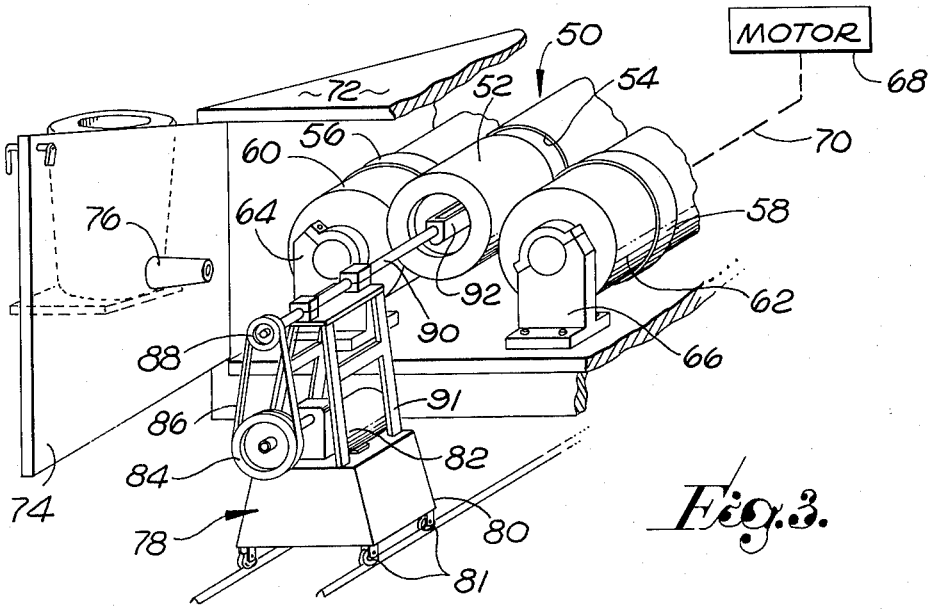
Fig. 3.
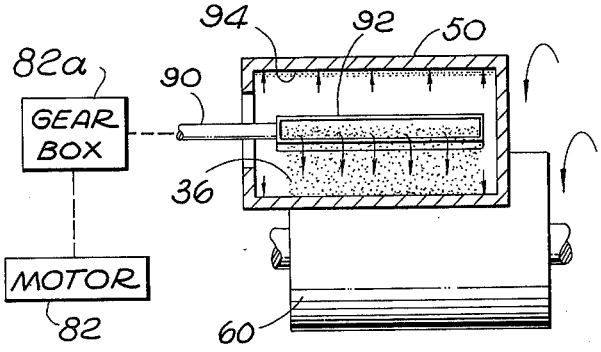
Fig. 4.
Fig. 5.
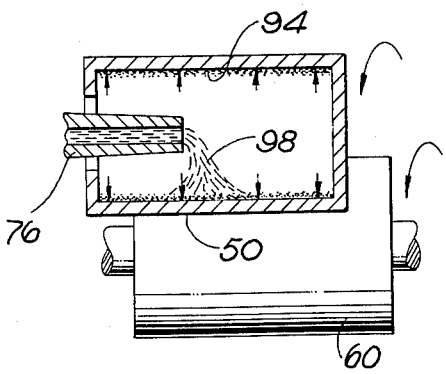

PROCESS FOR CASTING FACED OBJECTS USING CENTRIFUGAL TECHNIQUES

BACKGROUND AND SUMMARY OF THE INVENTION

The need sometimes arises for a machine component or other structure, which consists of a base or body of one material, carrying an external layer providing a face that consists of another material. Specifically, for example, the need frequently arises for rollers that are faced with a material that will resist wear for substantial intervals of rotary engagement with abrasive substances. As a specific example of a facing material, carbides, e.g., tungsten carbide materials, have been determined to be exceedingly hard and wear resistant. Consequently, a considerable need exists for machine components of steel, that are faced with such carbides.

Various techniques have been proposed to surface machine components with tungsten carbide material. For example, it has been proposed to apply weld metal (bearing tungsten carbide particles) to provide a layer carrying the hard particles. However, as the tungsten carbide particles are substantially heavier than the weld metal, they tend to sink within the weld puddle at the point of application and accordingly are somewhat removed from the exposed surface. Also abrasives, fluxes and flame-spraying techniques have been proposed for adhering carbides to molds, as disclosed in U.S. Pat. Nos. 3,553,905 (Lemelson) and 3,028,644 (Waldrop). However, such methods tend to inhibit production rates. Thus, difficulties have continued with various systems proposed for accomplishing a roller that is faced with tungsten carbide material. Consequently, a substantial need exists for an economical and effective system for the production of such hard-faced structures.

In general, one aspect of the present invention involves providing particulate-faced rollers by the use of centrifugal casting techniques. More specifically, a mold is provided to define an internal support surface which is coincident with the desired particulate external surface of the roller to be produced. The mold is then rotated to develop a centrifugal force extending toward its internal support surface. Recognizing prior centrifugal casting techniques, as disclosed in U.S. Pat. Nos. 2,645,558 (Burchartz) and 1,699,612 (Doat) wherein protective mold linings have been proposed; U.S. Pat. No. 3,468,997 (Pickels) wherein particulate matter is oriented and U.S. Pat. No. 2,260,593 (Wittlinger et al.) of concern regarding metal distribution, the present system is quite distinct. That is, a phenomena and characteristics of components employed to accomplish the phenomena, distinguish the present system from prior art methods and techniques. For example, the above-referenced patent 2,645,558 discloses the incorporation of cast iron chips from a mold lining into the casting; however, such was a problem to be avoided and was a surface condition, the casting metal freezing, almost on contact with the chips.

In accordance with the present invention, particles of tungsten carbide are placed in the mold along with molten metal, which is lighter (less dense) than the particles and has a lower melting point. Consequently, the solid particles are held at the support surface. However, the molten metal is characterized and forces are developed to move the molten metal into the interstices between the particles. As the metal wets the particles, upon solidification, they are securely held at the face of the casting in a dense matrix of the base metal which is integral with a metal body.

In addition to the problems treated above, some further difficulties are encountered in the formation of rollers subsequent the discovery of the centrifugal casting technique. Specifically, at best it is impractical to machine the tungsten-carbide surface of the roller due to the nature of that substance. Furthermore, the centrifugal casting has a side effect that imparts a characteristic of poor machinability to the matrix metal. That is, the rapid cooling of the casting results in a metallurgical structure (graphite flake) that is difficult to machine. Consequently, a substantial problem exists in producing a roller with a cylindrical tungsten-carbide surface and a true bore to receive a journal. Additionally, in many applications, the material of the roller must have a high compressive yield strength to avoid cold-flow forming in use. Resistance to impact and shock are also important. Of course, in addition to the above characteristics, as suggested above, the matrix metal (alloy) must have: good fluidity to penetrate the particle layer, and low surface tension to wet the particles. These specifications in combination present a substantial problem. Accordingly, other aspects of the present invention reside in post-casting treatment of the roller and alloy material.

BRIEF DESCRIPTION OF THE DRAWINGS

In the drawings, which constitute a part of this specification, an exemplary embodiment exhibiting various objectives and features hereof is set forth as follows:

FIG. 1 is a preliminary diagrammatic view illustrative of the system of the present invention;

FIG. 2 is a fragmentary sectional view taken through a casting produced in accordance with the present invention;

FIG. 3 is a fragmentary perspective view of an apparatus constructed in accordance with the present invention;

FIG. 4 is a sectional and diagrammatic view illustrative of one stage of operation for the apparatus of FIG. 3; and FIG. 5 is a view similar to FIG. 4 illustrative of another stage of operation for the apparatus of FIG. 3.

DETAILED DESCRIPTION OF THE ILLUSTRATIVE EMBODIMENT

As required, a detailed illustrative embodiment of the invention is disclosed herein. The embodiment exemplifies the invention which may, of course, be embodied in other forms, some of which may be radically different from the illustrative embodiment as disclosed. However, the specific metallurgical and structural details disclosed herein are representative and they provide a basis for the claims which define the scope of the present invention.

Referring initially to FIG. 1, to consider the production of a cylindrical roller that is faced with particulate tungsten-carbide material, the process initially will be considered somewhat generally. A centrifugal casting system in accordance herewith incorporates a mold 10 including a cylinder 12, one end of which is closed by a disk 14 (right) while the other end (left) is partly closed by an easily-removable disk 16. A central opening is defined in the disk 16 for introducing casting materials into the mold 10.

The mold 10 is horizontally supported for rotation about its central axis and in that regard, is coupled to a motor 24 by a rotary support shaft 26. Generally, in accordance with the present invention, a particulate-faced casting is accomplished in the mold 10 by initially providing particles from a source 27, which particles are accumulated as a layer 29 on the internal cylindrical surface 28 of the mold 10. The particles are held in the layer 29 by the centrifugal force resulting from the revolution of the mold 10. Next, molten metal of specific characteristics is supplied from a source 30 while the mold 10 operates above a minimum speed to develop a concentric cylindrical casting 32 of the desired form within the mold 10. Material characteristics and speed are such that as the mold 10 turns about its axis, the centrifugal force holds the heavier particulate layer 29 at the surface 28. However before freezing, the molten metal flows into the layer 29, filling the interstices which are backed by a body of the molten metal. Of course, gases, slag particles and other low-density inclusions are forced to the center of the casting, as recognized by the prior art (U.S. Pat. No. 3,468,997 Pickels).

A fragment of the casting 32 is illustrated in FIG. 2 and is representative of an actual photomicrograph of a tungsten-carbide-steel roller. The external surface 34 of the casting 32 is substantially defined by tungsten carbide particles 36 in the layer 29. The particles 36 are supported in a dense matrix 40 of the base metal. As illustrated, internal of the layer 29, the base metal body 42 is substantially free of particles 36. Thus, the concentrated layer 29 of particles 36 held in the dense matrix 40 affords a surface that is exceedingly hard and resistant to wear. Such a structure has widespread application, as in the field of material handling, e.g. pelletizing machines in which such rollers will withstand forceful engagement of abrasive ingredients over extended intervals of use.

Considering the details of an illustrative casting machine as successfully employed for use in the practice of the present invention, reference will now be made to FIG. 3 showing a mold 50, the external cylindrical surface 52 of which defines a concentric groove 54 which matingly receives opposed annular ridges 56 and 58 that are carried on spaced apart cylinders 60 and 62, respectively. The surface engagement of the mold 50 with the cylinders 60 and 62 enables the mold 50 to be rotated by the rollers 60 and 62.

A pair of rotational support structures 64 and 66 carry the rollers 60 and 62, respectively, for free rotation about their central axes. Additionally, the roller 62 is coupled to a motor 68 by a mechanical linkage, represented as a dashed line 70, e.g. a belt drive. The rollers 60 and 62, supported on the structures 64 and 66, along with the motor 68 are mounted in a housing 72 which incorporates a hinge-mounted door 74 that in turn supports a feed channel structure 76 for supplying molten metal to the interior of the mold 50. Granular or pulverized solid particles are dispensed within the mold 50 by an apparatus 78. Thus, during one stage of the process, the apparatus 78 is employed to line the mold 50 with a layer of particles, then during another stage of operation the structure 76 is employed for supplying molten metal inside the mold 50.

The apparatus 78 incorporates a support base 80 mounted on wheels 81 and carrying a reduction-gear motor 82, the shaft of which is connected to revolve a drive wheel 84 at a very slow rate. The wheel 84 is connected by a belt 86 to a drive wheel 88 which in turn is connected to a shaft 90 that is rotatably supported at the apex of a frame 91, supported on the base 80. The shaft 90 terminates in an aligned elongate trough 92 from which the solid particles are dispensed.

Considering the operation of the system as depicted in FIG. 3, reference will now be made to sectional and diagrammatic FIGS. 4 and 5 in the course of an explanation of a specific exemplary casting operation. The process will be described which has been successfully practiced to accomplish a roller that is faced usefully with tungsten-carbide. A specific roller formed in accordance herewith had an external cylindrical surface of approximately 100 square inches. As an initial step in the formation of the roller, the trough 92 (FIG. 4) is substantially filled with tungsten-carbide particles. In that regard, it has been determined that the particles should be of at least twenty mesh size to provide interstices sufficiently large to receive an effective quantity of metal in the matrix 40.

With the trough 92 filled, the motor 68 (FIG. 3) is energized with the result that the mold 50 attains a speed of approximately 1200 revolutions per minute. In that regard, for the tungsten carbide particles to be effectively placed, then infiltrated, a speed of at least 1000 revolutions per minute has been determined to be somewhat critical in relation to alloys having the requisite characteristics.

The motor 82 (FIG. 4) is actuated to drive the shaft 90 (through a gearbox 82*a*) with the trough 92 positioned as illustrated in FIGS. 3 and 4. The elongated trough 92 is turned through a fraction of one complete revolution to dispense the particles 36 over the internal support surface 94 of the mold 50 during an interval of approximately one minute. Generally, by dropping the particles 36 substantially along the entire axis of the cylindrical mold 50 at a gradual rate, they are deposited in a substantially uniform layer.

Upon completion of the particle layer 29 supported by the surface 94 and held in position by centrifugal forces, the apparatus 78 (FIG. 3) is moved clear of the mold 50, and the door 74 is closed so that the mold feed passage or channel structure 76 extends into the mold 50. With the components in that configuration, in the specific example, the rotary speed of the mold 50 is increased substantially. For tungsten carbide and alloys herein, increase is to approximately 1550 revolutions per minute and to delay freezing, the mold 50 may also be elevated in temperature to at least 250°F. Thereafter, the molten metal, i.e. alloy, as described in detail below, is flowed through the channel structure 76 to be received within the mold 50 as illustrated in FIG. 5. As well known in the art of centrifugal casting, the molten metal of the stream 98 is distributed over the surface 94 of the mold 50 in a substantially-uniform layer. However, insofar as the present system is concerned, it is important to recognize that the molten metal from the stream 98 encases the heavier particles 36 at an external surface of the casting, and develops the supporting body of the castng. Upon completion of the process as described above, the casting is removed to provide a roller substantially as represented by the fragment of FIG. 2.

Regarding the alloy for the metal stream 98, first recognize that the density of the tungsten carbide must be greater than the density of the molten metal. In addition to penetrating or infiltrating the tungsten-carbide particles prior to freezing, and having the characteristic of low surface tension (to wet the particles), the casting metal (stream 98) has other distinctions that are somewhat necessary. Other requisite characteristics of the alloy, as indicated above include: high compressive yield strength (generally in excess of 75,000 pounds per square inch); resistance to shock and impact (a Charpy Vee Notch impact strength of at least 2.5 foot pounds at room temperature and a percent elongation of under 3.0). The alloy must also be formable into a roller for true cylindrical mounting. To attain such an accomplishment in accordance herewith, an alloy is employed that is dimensionally stable after casting and as explained below after heat treatment.

In accordance herewith, alloys in a range below have been discovered to be very effective in the process of the present invention.

| COMPONENT | PERCENT BY WEIGHT |
|---|---|
| Carbon | 2.8 – 3.3 |
| Manganese | 0.25 Maximum |
| Silicon | 1.8 – 2.8 |
| Nickel | 8.0 – 9.0 |
| Magnesium | 0.03 Minimum |
| Molybdenum | 0.05 – 0.15 |
| Iron | Balance |

Other satisfactory alloys each include a major percentage of iron, between 2.5 and 3.5 percent carbon; at least 0.03 magnesium for nodule forming; some deoxidizers, e.g. silicon or manganese; and sufficient alloying metals to provide strength and resistance to shock and impact as indicated above.

The alloys, as described above would normally be expected to provide a casting that could be readily machined. However, the fast cooling rate inherent in the centrifugal casting process results in a metallurgical structure of approximately 50 Rockwell "C" (too hard for good machinability). In accordance herewith, a roller is further processed by annealing. Specifically, the roller is heat treated at elevated temperatures in an inert atmosphere, e.g. hydrogen, vacuum etc., to avoid oxidizing the tungsten carbide. Temperatures should be above 1500°F. and generally 1750°F. has been determined to be effective. As a consequence, the hardness drops to the range of 30 to 40 Rockwell C which can be easily machined to provide a roller with a bore to receive a journal.

Thus, in summary, it may be seen that a roller, for machine use, and faced with tungsten carbide can be effectively cast by using particles larger than a minimum size, and a casting metal of certain specific characteristics, then annealing and machining the casting to a sufficiently true shape. However, the specific scope hereof should be as defined by the claims below.

I claim:

1. A process for producing hard-faced metal roller structures, comprising the steps of:

providing a mold defining a cylindrical internal support surface that is definitive of the external configuration for one of said roller structures;

rotating said mold to develop centrifugal forces toward said internal support surface thereof, adequate to position dense particles thereon;

loosely distributing tungsten carbide particles of at least twenty mesh size on said support surface whereby said centrifugal forces hold said particles for retention at said support surface;

injecting molten metal into said mold, said molten metal being less dense than said particles and at a temperature below the melting temperature of said particles whereby said particles tend to remain positioned contiguous to said surface as a result of said centrifugal forces; and rotating said mold containing said particles and said molten metal at a speed in excess of 1000 revolutions per minute to develop said centrifugal forces such that said lessdense molten metal moves about said particles and solidifies in contact therewith, to provide a solid roller structure faced with said particles.

2. A process according to claim 1 further including the step of annealing said solid roller structure to reduce the hardness to a machinable level below 45 Rockwell C.

3. A process according to claim 1 wherein said molten metal further comprises an alloy having a compressive yield strength in excess of 75,000 pounds per square inch.

4. A process according to claim 1 wherein said molten metal further comprises an alloy having a Charpy Vee Notch impact strength of at least 2.5 foot pounds at room temperature and a percentage elongation of at least 2.0.

5. A process according to claim 1 wherein said molten metal further comprises an alloy having sufficient dimensional stability whereby the circumference of the roller will not deviate from a radius in excess of 1.5%.

6. A process according to claim 1 wherein said molten metal further comprises an alloy having a compressive yield strength in excess of 75,000 pounds per square inch, a Charpy Vee Notch impact strength of at least 2.5 foot pounds at room temperature and a percentage elongation of at least 2.0, and sufficient dimensional stability whereby the circumference of the roller will not deviate from a radius in excess of 1.5%.

7. A process according to claim 1 wherein said molten metal further comprises an alloy having a major percentage of iron, between 2.5 and 3.5 percent by weight of carbon, at least 0.03 percent by weight of magnesium and a quantity of strengthening alloy metals.

8. A process for producing hard-faced metal roller structures, comprising the steps of:

providing a mold defining a cylindrical internal support surface that is definitive of the external configuration for one of said roller structures;

rotating said mold to develop centrifugal forces toward said internal support surface thereof, adequate to position dense particles thereon;

distributing dense particles loosely on said support surface whereby said centrifugal forces hold said particles for retention at said support surface;

injecting molten metal into said mold, said molten metal being less dense than said particles and at a temperature below the melting temperature of said particles whereby said particles tend to remain positioned contiguous to said surface as a result of said centrifugal forces, said molten metal further having low surface tension to wet said particles;

rotating said mold containing said particles and said molten metal to develop said centrifugal forces such that said less-dense molten metal moves about said particles and solidifies to provide a solid structure faced with said particles; and removing said solid structure from said mold to heat treatment whereby to significantly reduce the hardness thereof.

9. A process according to claim 8 wherein said dense particles comprise tungsten carbide, the major portion of which are at least of twenty mesh size and said molten metal comprises a major portion of iron, at least between 2.5 and 3.5 percent by weight carbon, at least 0.3 percent by weight magnesium and at least 5.0 percent alloying metal to provide increased strength.

10. A process according to claim 9 wherein said mold is rotated at a speed of at least 1,000 revolutions per minute.

11. A process according to claim 8 further including the step of pre-heating said mold to at least 250°F.

* * * * *